US006162308A

United States Patent [19]

Heckelmann et al.

[11] Patent Number: 6,162,308

[45] Date of Patent: Dec. 19, 2000

[54] PROCESS FOR PRODUCING AN EASILY SHAPED COLD-ROLLED SHEET OR STRIP

[75] Inventors: Ilse Heckelmann, Xanten; Ullrich Heidtmann, Bottrop; Rolf Bode, Wesel, all of Germany

[73] Assignee: Thyssen Stahl AG, Duisburg, Germany

[21] Appl. No.: 09/171,837

[22] PCT Filed: Apr. 26, 1997

[86] PCT No.: PCT/EP97/02169

§ 371 Date: Oct. 27, 1998

§ 102(e) Date: Oct. 27, 1998

[87] PCT Pub. No.: WO97/46720

PCT Pub. Date: Dec. 11, 1997

[30] Foreign Application Priority Data

Jun. 1, 1996 [DE] Germany ..... 196 22 164

[51] Int. Cl.[7] ..... C21D 8/02

[52] U.S. Cl. ..... 148/603; 148/651; 148/652; 148/661

[58] Field of Search ..... 148/603, 651, 148/652, 661

[56] References Cited

FOREIGN PATENT DOCUMENTS 52-46323 4/1977 Japan .

*Primary Examiner*—Deborah Yee

*Attorney, Agent, or Firm*—Proskauer Rose LLP

[57] ABSTRACT

A method for producing a cold-rolled steel sheet or strip with good formability, especially stretch formability, for making pressings with a high buckling resistance from a steel comprising (in % by mass): 0.01 to 0.08% C, 0.10 to 0.80% Mn, maximum 0.15% Si, 0.015 to 0.08% Al, a maximum 0.005% N, 0.01 to 0.04% Ti and/or Nb, whose contents exceeding the quantity necessary for stoichiometric binding of the nitrogen, ranges from 0.003 to 0.015% Ti or 0.0015 to 0.008% Nb, and a maximum 0.15% in total of one or several elements from the group copper, vanadium, nickel, the remainder being iron, including unavoidable impurities, including a maximum 0.08% P and a maximum 0.02% S, comprises preheating the cast slab to a temperature exceeding 1050° C., hot-rolling at a final temperature ranging from over the $Ar_3$ temperature to 950° C., coiling the hot-rolled strip at a temperature ranging from 550 to 750° C., cold-rolling at a total cold-rolling degree of deformation from 40 to 85%, recrystallization annealing of the cold strip in a continuous furnace at a temperature of at least 720° C., subsequent cooling at 5 to 70 K/s; and skin passing.

4 Claims, 1 Drawing Sheet

PROCESS FOR PRODUCING AN EASILY SHAPED COLD-ROLLED SHEET OR STRIP

This application is a 371 of PCT/EP97/02169 filed Apr. 26, 1997.

BACKGROUND OF THE INVENTION

The invention relates to a method for producing a cold-rolled sheet or strip of superior strength having good formability especially stretch-formability for making pressings with a high buckling resistance.

The pressings are to be of high basic material strength and after additional heat treatment as it is usually applied for enamelling, they are to receive additional bake hardening. In this way, outstanding buckling resistance characteristics are achieved. For example body sheets in the motor vehicle industry, such as doors, hoods, roofs, are pressings comprising a high degree of stretch-forming.

In the production of continuous-annealed aluminium killed non-alloyed deep-drawing steels and which have particular requirements in respect of formability, after cooling from the recrystallization temperature, an additional annealing, so-called overageing annealing, is applied to ensure ageing stability. A non-ageing material is characterized in that even after extended storage periods no significant changes occur in the material's properties and further processing free of stretcher strain and free of defects is possible. In a continuous furnace such treatment can take place in an in-line overageing section. In the case of strip which is produced in a common hot-coating plant, subsequent external annealing, usually in the coil, needs to be carried out. Aluminium-killed non-alloyed deep-drawn steels, also called low-carbon (LC) steels, have a carbon content ranging from 0.02 to 0.08%.

Above all in motor vehicle body building, for reasons of weight reduction, the use of the thinnest possible sheet is desired. To provide the required buckling resistance in spite of sheets of reduced thickness, higher strengths are required. Increasingly, bake-hardening steels are used for this purpose. Steels with bake-hardening properties are characterized by an additional increase in yield strength of the drawn component. Such an increase is achieved in that the material, apart from the work hardening occurring during pressing, is subjected to an additional increase in strength, the so-called bake hardening. The physical reason for this is a carbon-ageing occurring under controlled conditions. Bake-hardening steels and their intended applications also require adequate ageing stability for surfaces free from imperfections after pressing.

In continuous furnaces comprising an in-line overageing section, a non-alloyed LC steel can also be produced as a bake hardening steel, in that the chemical composition of the steel, the rate of cooling and the overageing condition are exactly matched to each other. This process is already used on a commercial scale. Optimization of the production conditions is for example described by Hayashida et al. (T. Hayashida, M. Oda, T. Yamada, Y. Matsukawa, J. Tanaka: "Development and applications of continuous-annealed low-carbon Al-killed BH steel sheets", Proc. of the Symp. on High-strength sheet steels for the automotive industry, Baltimore, Oct. 16–19, 1994, p. 135).

In other processes for producing non-ageing cold-rolled steels with bake hardening properties in continuous strip plants, low-carbon steels, so-called ultra low carbon (ULC) steels are used. A process based on a ULC steel for hot-coating plants, partially stabilized with titanium, is described by N. Mizui, A. Okamoto, T. Tanioku: "Recent development in bake-hardenable sheet steel for automotive body panels", International conference "Steel in automotive construction", Würzburg 24.–26.9.1990). The carbon content is to be between 15 and 25 ppm. The titanium content is matched to the nitrogen and sulphur contents with $48/14\ N<Ti<48\ (N/14+S/32)$. The aim is a complete binding of the nitrogen in titanium nitrides, however a small quantity of carbon must remain soluble to ensure the bake-hardening effect takes place. Production in a vacuum degassing plant is necessary. This process has the advantage that overageing annealing can be omitted, thus making it suitable for hot-coating plants. With steels produced in this way, the bake-hardening parameters determined in tension specimens after 2% initial elongation ($BH_2$ value) are approx. 40 $N/mm^2$. The yield strength is approx. 200 $N/mm^2$; the values for average vertical anisotropy (r value) are approx. 1.8.

According to W. Bleck, R. Bode, O. Maid, L. Meyer: "Metallurgical design of high-strength ULC steels", Proc. of the symp. on high-strength sheet steels for the automotive industry, Baltimore, Oct. 16–19, 1994), for representing such ULC steels partially stabilized with titanium, titanium contents are between 0.6 times and 3.4 times the nitrogen content. The sum of carbon and nitrogen contents should not exceed 50 ppm.

EP 0 620 288 A1 discloses a process for producing steel strip which is only cold-rolled or hot-coated in continuous strip plants, with this steel strip apart from ageing stability also comprising high bake-hardening characteristics and good deep-draw characteristics due to high r values. A ULC steel on its own or a ULC steel either with a titanium alloy or an niobium alloy is annealed above the $Ac_3$ transformation temperature, i.e. in the austenitic range. In this process, the bake-hardening values attain 100 $N/mm^2$. No overageing annealing is necessary. As this is a ULC steel, steel production must take place in a vacuum degassing plant. The high annealing temperatures necessary with this process create difficulties regarding strip flatness. Application of this process on a commercial scale is not known.

Bleck et al. (op. cit.) point out that the production of a non-ageing steel with good shaping characteristics based on non-alloyed LC steels, is not possible without overageing, in continuous strip plants. Since the cooling process in hot-coating plants in current use is limited due to the hot-dip galvanizing setup, in-line overageing annealing as mentioned above cannot take place. Consequently, with the known state of the art, the production of non-ageing steels with bake-hardening properties, in hot-coating plants, is exclusively limited to ULC steels. Thus the processes, applied so far or described in the literature, for producing in continuous strip plants, cold-rolled sheet with good formability and which comprises bake-hardening properties, either necessitate the additional annealing treatment as described above (if a soft non-alloyed Al-killed deep-drawn steel is used), with such a production not being possible in a hot-coating plant; or else they necessitate the use of ULC steels of very low carbon content, with these steels being more expensive to produce. The processes described above based on ULC steels mainly comprise steels with yield strength in the lower region up to 240 $N/mm^2$. Due to the high average r values (>1.5) they are used for pressings with a high degree of deep drawing.

SUMMARY OF THE INVENTION

It is thus the object of the present invention to produce, in a continuous strip plant without subsequent overageing-annealing treatment, a non-ageing cold-rolled steel sheet or strip of superior strength with good formability and with a high buckling resistance; with the said sheet or strip also comprising good bake-hardening properties. The combination of high basic material strength and bake-hardening potential is to provide the pressings with excellent resistance to buckling.

This object is met by a method for producing a cold-rolled sheet or strip with good formability, and especially stretch-formability, for making pressings with a high buckling resistance from a steel comprising (in % by mass):

0.01–0.08% C 0.10–0.80% Mn max. 0.60% Si 0.015–0.08% Al max. 0.005% N 0.01–0.04% Ti and/or Nb whose contents exceeding the quantity necessary for stoichiometric bonding with nitrogen, ranges from 0.003 to 0.015% Ti or 0.0015 to 0.008% Nb, max. 0.15% in total of one or several elements from the group copper, vanadium, nickel, the remainder being iron, including unavoidable impurities, including max. 0.08% P and max. 0.02% S, with the following steps:

preheating the cast slab to a temperature exceeding 1050° C.; hot-rolling at a final temperature ranging from over the $Ar_3$ temperature to 950° C., preferably ranging from 870 to 950° C.; coiling the hot-rolled strip to a temperature ranging from 550 to 750° C.; cold-rolling with a total degree of deformation from 40 to 85%; recrystallization annealing of the cold strip in a continuous furnace at a temperature of at least 720° C. with subsequent cooling with high cooling rates of 5 to 70 K/s; and then skin passing.

The steel's non-ageing properties are achieved by an addition of titanium which is matched to the nitrogen content. This results in an early complete binding of the nitrogen, an element known to significantly influence ageing stability. In the ageing tests (see examples below) it was found that ageing stability is adequate when a quantity of titanium is present which exceeds the quantity of titanium in nitrogen binding, thus ensuring the formation of a minimum quantity of titanium carbides. So as to provide the steel with the strengthening characteristics necessary for the high degree of deformation, and adequate elongation and ductility characteristics, the volume and number of titanium carbides must however not be too high. Thus the quantity of the nitride-forming agent not bound to nitrogen should be 0.003 to 0.015% Ti or 0.0015 to 0.008% Nb. This limitation of the percentage of nitride forming agents ensures even mechanical properties which are largely invariable to process-bound fluctuations in hot-strip temperature control (influencing the precipitation distribution).

The application of this analysis concept ensures the presence of sufficient dissolved carbon, after cooling from the recrystallization temperature, for good bake-hardening properties.

Together with, or instead of, titanium as a micro alloy element, niobium can also be used for nitride and carbide formation.

For hot galvanized sheet, the silicon content should preferably be limited to max. 0.15%.

The method according to the invention has the economic advantage of omitting the additional process step of over-ageing annealing to achieve ageing stability, although the steel composition is based on the analysis of soft non-alloyed Al-killed (LC) steels. Due to this analysis concept, steel production can take place without expensive metallurgical production processes. In addition, only small quantities of titanium or niobium are required; as a result the steel can also be economically produced from the point of view of alloying additions.

DETAILED DESCRIPTION OF THE INVENTION

Figure 1:
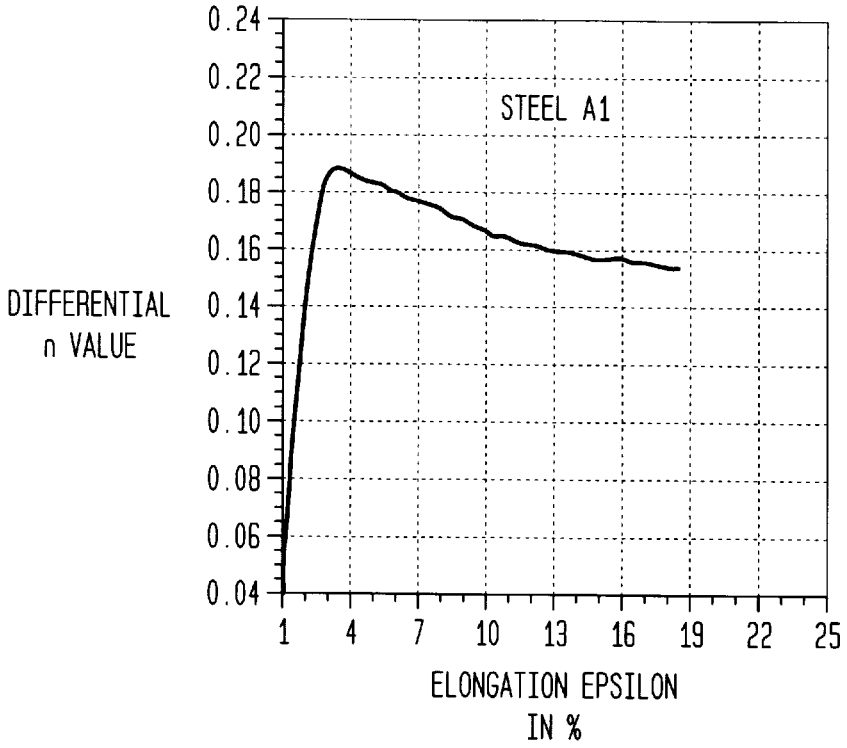
FIG. 1 is a graphical representation of the differential strengthening index versus the total elongation for steel having a coiling temperature of 730° C.

The method comprises the following steps:

preheating the cast slab to a temperature exceeding 1050° C.;

hot-rolling at a final temperature ranging from $>Ar_3$ to 950° C.;

coiling the hot-rolled strip in a temperature range of 550 to 750° C.;

cold-rolling with a total cold-rolling degree of deformation from 40 to 85%;

recrystallization annealing of the cold strip in a continuous furnace at a temperature of at least 720° C.;

subsequent cooling at 5 to 70 K/s; and skin passing.

Preferably, the cold strip is heated to the temperature of recrystallization annealing at a rate of 5 to 10 K/s. Preferably, recrystallization annealing takes place in-line in a zinc hot-galvanizing plant.

The steel strip or sheets produced according to the invention are characterized by a high initial yield strength (exceeding 240 $N/mm^2$) and a high strengthening ability in the range of small plastic elongation. Together with low values of vertical anisotropy which indicate a preferred flowing from thickness, a high degree of stretch-forming in pressings makes these ideal for automotive application, e.g. automotive body parts. The significant strengthening of this material which already occurs with small plastic deformation and which manifests itself in very high work-hardening values, constitutes a significant factor in the characteristics of this product. The significant strengthening encourages load transmission to adjacent areas of the material, thus avoiding early local material failure, e.g. constriction. Thus the material can flow more evenly across the entire surface of the pressing. In addition, the small variations in the r values depending on the angle to the rolling direction encourage an even deformation behavior. This isotropic behavior is upheld by small values in the planar anisotropy.

EXAMPLE

The slabs made by continuous casting of the steels A and B produced according to the invention, whose chemical compositions are shown in Table 1, were reheated in a pusher-type heating furnace to temperatures of approx. 1200° C. and hot-rolled above the $Ar_3$ temperature to final thicknesses of 2.8–3.3 mm. The final rolling and coiling temperatures can be seen from Table 2. For the strip of the steels A and B, two coiling temperature classes were used: 730° C. (Steels A1 and B1) and 600° C. (Steels A2 and B2).

The strips were cold-rolled to thicknesses between 0.8 and 1.0 mm with degrees of deformation between 65 and 75% and subsequently in a hot-coating plant they were first subjected to recrystallization annealing and then zinc coated by hot-dip galvanization. The strip temperature in the recrystallization furnace was 800° C. The cooling rates after recrystallizing annealing were between 10 and 50 K/s. The zinc coated strips were skin pass rolled at 1.8% and after that were free of yield strength elongation.

Tables 2 and 3 show the mechanical characteristics and grain sizes, determined during tension tests, of the strips A and B, measured at an angle of 90° to the direction of rolling. Only the r values and the values for the planar anisotropy are calculated as follows, in each instance from three tension specimens which were derived in the angular positions of 0°, 45° and 90° to the direction of rolling $r_m=(r_0°+2\ r_{45}°+r_{90}°)/4,$ $\Delta r=(r_0°-2\ r_{45}°+r_{90}°)/2.$ The $BH_0$ value corresponds to the increase in the lower yield strength after heat treatment of 20 minutes at 170° C. The value WH indicates the extent of work hardening at a stretching of the tension specimen by 2% The amount is calculated by subtracting the yield strength $Rp_{0.2}$ from the tension measured at 2% deformation. The value $BH_2$ corresponds to the rise of the lower yield strength after heat treatment of 20 minutes at 170° C., measured at the tension specimen pre-stretched by 2%.

Figure 2:
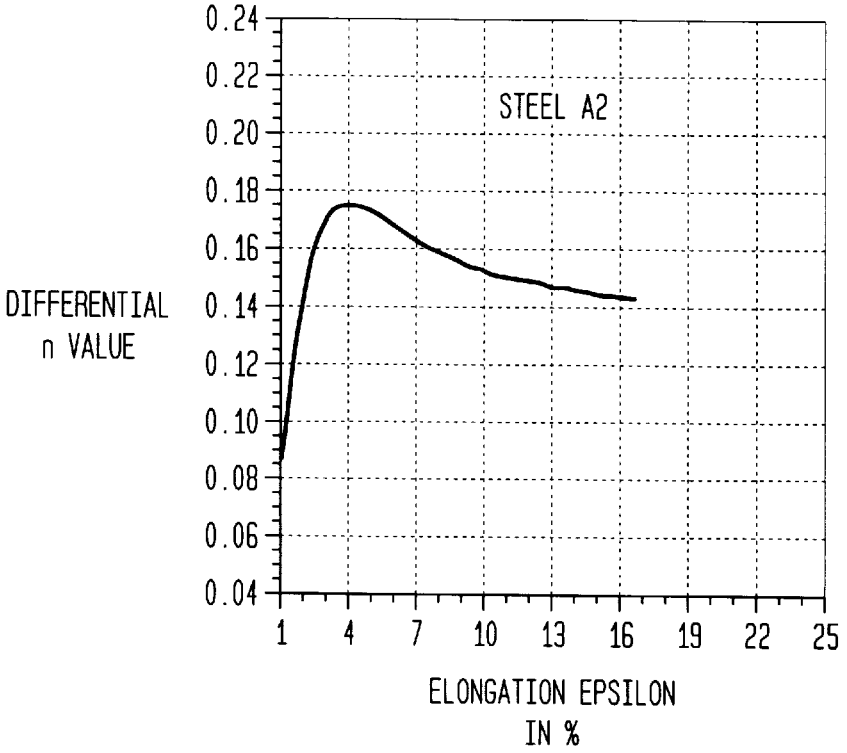
FIG. 2, is a graphical representation of the differential strengthening index versus the total elongation for steel having a coiling temperature of 600° C.

After artificial ageing of 60 minutes at 100° C., the zinc hot dip galvanized cold-rolled strips from steels A and B show a nearly unchanged level of the lower or upper yield strength (Table 3). The shaping of the yield strength too remains below 0.5% as a result of which ageing stability for processing free of stretch strains is adequate even after extended storage periods. The curve of the differential (momentary) strengthening index (n value) above total elongation is shown in FIG. 1 for steel A1 (coiling temperature 730° C.) and in FIG. 2 for steel A2 (coiling temperature 600° C.). The maximums of the differential n values are shown in Table 2; with the steels A and B they attain at least 0.170 for both coiling temperature classes; in the case of high coiling temperatures even a minimum of 0.180. The n value maximum of the steels A and B is in the range of little overall expansion, between 2 and 5%. For the higher-coiled variants A1 and B1, the yield strength are approx. 50 N/mm$^2$ higher than for the low-coiled variants A2 and B2, so that the initial position of the yield strength can be determined by selecting the coiling temperature. The values for the average vertical anisotropy of the steels A1, A2, B1 and B2 according to the invention are a low 1.0–1.1. Irrespective of the coiling temperature, they have isotropic characteristics with Δr values between 0 and 0.3. When using the high coiling temperatures, the work hardening values which represent a measure of the strengthening by plastic deformation, are very high at approx. 50 N/mm$^2$. Irrespective of the coiling temperature, the parameters for bake-hardening with or without initial forming reach at least 45 N/mm$^2$ in all cases. The increase in the yield strength after painting a pressed component can be estimated by the sum $WH+BH_2$. In the case of the high coiling temperatures (steels A1 and B12), these values are at least 100 N/mm$^2$. In the case of the lower coiling temperatures (steels A2 and B2) the sum $WH+BH_2$ is still favorable, being at least 60 N/mm$^2$.

Tables 1, 2 and 3 additionally show steels C to E for comparison. By contrast to the steels A and B, these steels either contain no titanium (steel E) or else comprise titanium contents which are sub-stoichiometric in respect of the nitrogen content (steels C and D with Ti/N<3.4). The values of the initial condition, i.e. non-aged, refer to the skin pass rolled condition. In the case of these comparison steels, the rise of the lower yield strength ($R_{el}$) and the yield strength elongation after artificial ageing are significantly higher than with the steels A and B produced according to the invention. Above all the upper yield strength ($R_{eh}$) increases up to 70 N/mm$^2$. Fault-free processing after extended storage is not possible in the case of steels C to E.

Steel F does not contain any titanium but niobium. Due to the coiling temperature of 600° C. and the alloying with niobium, its yield strength is very high at 350 N/mm$^2$. The average r value is 1.0 and the Δr value at −0.20 is favorable for even formability behavior. As is the case with steels A and B which are titanium alloyed, with the Nb-alloyed steel F, the lower and upper yield strength are also stable and the yield strength elongation is below 1% so that here too, processing free of any stretch strains is possible after extended storage periods of the material.

The formability of steels A1 and B1 produced according to the invention was comprehensively examined in a large-scale trial under near-practical conditions, using press-moulded passenger motor vehicle bonnets. In regard to the pressings maintaining their shape and surface, excellent results were achieved which were reproducible during processing even after a storage period of 5 months.

TABLE 1

| Steel | C | Mn | Si | P | S | Al | N | Ti | Nb | Ti/N |
|---|---|---|---|---|---|---|---|---|---|---|
| A | 0.042 | 0.24 | 0.01 | 0.009 | 0.005 | 0.037 | 0.0028 | 0.016 | — | 5.7 |
| B | 0.041 | 0.24 | 0.05 | 0.009 | 0.005 | 0.042 | 0.0025 | 0.015 | — | 5.0 |
| C | 0.050 | 0.25 | 0.01 | 0.009 | 0.010 | 0.030 | 0.0042 | 0.009 | — | 2.1 |
| D | 0.044 | 0.26 | 0.01 | 0.011 | 0.007 | 0.038 | 0.0034 | 0.009 | — | 2.6 |
| E | 0.031 | 0.23 | 0.01 | 0.010 | 0.011 | 0.039 | 0.0045 | — | — | — |
| F | 0.062 | 0.71 | 0.01 | 0.016 | 0.005 | 0.043 | 0.0064 | — | 0.022 | — |

TABLE 2

| Steel | Final rolling temp. (° C.) | Coiling temp. (° C.) | Degree of cold rolling (%) | Thickness of cold strip (mm) | $Rp_{0.2}$ ($N/mm^2$) | Rm ($N/mm^2$) | A (%) | Average r value | Δ r | Grain size in $\mu m^2$ |
|---|---|---|---|---|---|---|---|---|---|---|
| A1 | 910 | 730 | 70 | 1.0 | 262 | 375 | 33 | 1.1 | 0.25 | 180 |
| A2 | 870 | 600 | 70 | 1.0 | 315 | 390 | 35 | 1.0 | 0.18 | 130 |
| B1 | 900 | 730 | 73 | 0.8 | 265 | 375 | 31 | 1.0 | 0.28 | 170 |
| B2 | 870 | 600 | 70 | 1.0 | 318 | 395 | 34 | 1.1 | 0.15 | 130 |
| C | 870 | 570 | 61 | 1.5 | 285 | 373 | 33 | | | |
| D | 880 | 600 | 65 | 1.0 | 298 | 390 | 33 | | | |
| E | 900 | 760 | 68 | 0.9 | 232 | 365 | 32 | | | 250 |
| F | 890 | 600 | 65 | 1.0 | 350 | 423 | 33 | 1.0 | — 0.20 | 100 |

TABLE 3

Ageing characteristics, work and bake-hardening values of the steels examined

| Steel | $\Delta R_{el}$ after ageing ($N/mm^2$) | $\Delta R_{eh}$ after ageing ($N/mm^2$) | ΔRe after ageing (%) | WH ($N/mm^2$) | $BH_0$ ($N/mm^2$) | $BH_2$ ($N/mm^2$) | $\eta_{max}$ | $\epsilon_{nmax}$ (%) | Remark |
|---|---|---|---|---|---|---|---|---|---|
| A1 | 0 | 3 | <0.5 | 51 | 63 | 65 | 0.187 | 3.0 | Invention |
| A2 | 0 | 2 | <0.5 | 11 | 45 | 53 | 0.171 | 3.5 | Invention |
| B1 | 1 | 3 | <0.3 | 44 | 61 | 58 | | | Invention |
| B2 | 2 | 3 | <0.5 | 20 | 41 | 52 | | | Invention |
| C | 14 | 63 | 3 | | | | | | Comparison |
| D | 17 | 55 | 3 | | | | | | Comparison |
| E | 21 | 46 | 2.5 | | | | | | Comparison |
| F | 0 | 1 | <0.5 | 33 | 46 | 47 | | | Invention |

Tensile tests were carried out on specimens measuring 80 mm in length.
"$\Delta R_{el}$ after ageing" indicates the increase in the lower yield strength after artificial ageing of the tension specimens (100° C., 60 minutes).
"$\Delta R_{eh}$ after ageing" indicates the increase in the upper yield strength after artificial ageing of the tension specimens (100° C., 60 minutes).
"ΔRe after ageing" indicates the yield strength elongation after artificial ageing of the tension specimens (100° C., 60 minutes).
"WH" indicates work-hardening after 2% stretching.
"$\eta_{max}$" indicates the maximum differential n value.
"$\epsilon_{nmax}$" indicates the degree of total elongation where the maximum n value occurs.

What is claimed is:

1. A method for producing a cold-rolled steel sheet or strip having good formability, including stretch-formability, for making pressings with a high buckling resistance from a steel comprising (in % by mass):

0.01 to 0.08% C 0.10 to 0.80% Mn maximum 0.15% Si 0.015 to 0.08% Al maximum 0.005% N 0.01 to 0.04% Ti and/or Nb, whose contents exceeding the quantity necessary for stoichiometric binding of the nitrogen, ranges from 0.003 to 0.015% Ti or 0.0015 to 0.008% Nb, and a maximum 0.15% in total of one or several elements from the group copper, vanadium, nickel, the remainder being iron, including unavoidable impurities, including a maximum 0.08 % P and a maximum 0.02% S; the method comprising:

preheating the cast slab to a temperature exceeding 1050° C.;

hot-rolling at a final temperature ranging from over the $Ar_3$ temperature to 950° C.;

coiling the hot-rolled strip at a temperature ranging from 550 to 750° C.;

cold-rolling at a total cold-rolling degree of deformation from 40 to 85%;

recrystallization annealing of the cold strip in a continuous furnace at a temperature of at least 720° C.;

subsequent cooling at 5 to 70 K/s; and skin passing.

2. The method according to claim 1 wherein the cold strip is heated to the temperature of recrystallization annealing at a rate ranging from 5 to 10 K/s.

3. The method according to claim 1 wherein recrystallization annealing of the cold-rolled strip takes place in-line in a zinc hot-dip galvanizing plant.

4. The method according to claim 1 wherein hot rolling takes place at a final temperature ranging from 870 to 950° C.

* * * * *